US006744204B2

(12) United States Patent
Groen et al.

(10) Patent No.: US 6,744,204 B2
(45) Date of Patent: Jun. 1, 2004

(54) GAS DISCHARGE LAMP

(75) Inventors: Wilhelm Albert Groen, Einighausen (DE); Petra Huppertz, Roetgen (DE); Knuth Albertsen, Goch (DE); Bernd Rausenberger, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/140,546

(22) Filed: May 7, 2002

(65) Prior Publication Data

US 2002/0171375 A1 Nov. 21, 2002

(30) Foreign Application Priority Data

May 9, 2001 (DE) ..... 101 22 392

(51) Int. Cl.[7] ..... H01J 17/04
(52) U.S. Cl. ..... 313/631; 313/633; 313/221
(58) Field of Search ..... 313/221, 231.11, 313/346 R, 491, 574, 623, 631, 633

(56) References Cited

U.S. PATENT DOCUMENTS 3,649,864 A * 3/1972 Willemsen ..... 313/221
4,449,071 A * 5/1984 Yokoyama ..... 315/53
5,654,606 A * 8/1997 Weijtens et al. ..... 313/491
5,830,028 A * 11/1998 Zovko et al. ..... 445/24

* cited by examiner

*Primary Examiner*—Don Wong
*Assistant Examiner*—Jimmy T. Vu

(57) ABSTRACT

A gas discharge lamp with at least one capacitive coupling structure (2, 3) is described, which lamp has the particular characteristic that the coupling structure (2, 3) comprises a ceramic material which comprises pure $BaTiO_3$. In particular an additional doping of at least part of the $BaTiO_3$ with barium leads to a material whose Curie temperature and saturation polarization are substantially higher and whose coercitive field strength is substantially smaller, so that a gas discharge lamp with a coupling structure manufactured from this material can be operated at substantially higher temperatures and at a lower operating voltage. Various dopings of the $BaTiO_3$ with titanium, manganese, and lead are furthermore described.

19 Claims, 2 Drawing Sheets

GAS DISCHARGE LAMP

The invention relates to a gas discharge lamp with at least one capacitive coupling structure.

Gas discharge lamps of this kind are usually formed by a discharge vessel with two ceramic electrodes which are fused into the vessel. A discharge gas is present inside the vessel. Various operational modes are known for exciting a gas discharge through the emission of electrons.

In addition to the generation of the electrons at so-called hot electrodes by means of glow emission, the gas discharge may alternatively be generated through the emission of electrons in a strong electric field, or directly through ion bombardment (ion-induced secondary emission). In a capacitive operational mode, capacitive coupling structures are used as the electrodes. These electrodes are formed from a dielectric material which is in contact with the discharge gas at one side and which is connected to an external current circuit with electrical conduction at the other side. An AC electric field is generated in the discharge vessel by means of an AC voltage applied to the electrodes, in which field the electrons move and excite a gas discharge in a known manner.

A gas discharge lamp operating by this principle is known from DE 199 15 616.6, in which the coupling structures are formed by a ferroelectric ceramic material. The ceramic material is formed by $Ba(Ti_{1-x}Zr_x)O_3$ with dopants of donor/acceptor combinations, a preferred value being chosen to be x=0.09. A high value of the dielectric constant and of the remanent polarization can be achieved with such a ceramic material.

It is an object of the invention to provide a gas discharge lamp of the kind mentioned in the opening paragraph whose operational properties are further improved, in particular as regards the luminous efficacy.

Furthermore, a gas discharge lamp is to be provided which can operate at higher operational temperatures as compared with the cited prior art.

This object is achieved with a gas discharge lamp having at least one capacitive coupling structure in that the coupling structure comprises a ceramic material which comprises pure $BaTiO_3$. The word "pure" in this connection should be understood to relate to $BaTiO_3$ which is not doped and comprises no zirconium.

A particular advantage of this solution lies in the fact that the operating temperature of gas discharge lamps with this ceramic material may be higher than 100° C., whereas it is limited to approximately 80° C. in the prior art cited above.

The dependent claims relate to advantageous further embodiments of the invention.

The Curie temperature of the ceramic material can be raised to above 130° C. with the embodiments as claimed in claims 2 and 7.

A coercitive field strength of less than 80 V/mm and a saturation polarization of at least 17 $\mu C/cm^2$ can be achieved in particular with the embodiments as claimed in claims 3 to 5.

The embodiment of claim 6 is offered for reasons of the simple manufacture of its material.

Further details, characteristics, and advantages of the invention will become apparent from the following description of preferred embodiments, given with reference to the drawing, in which.

Figure 1:
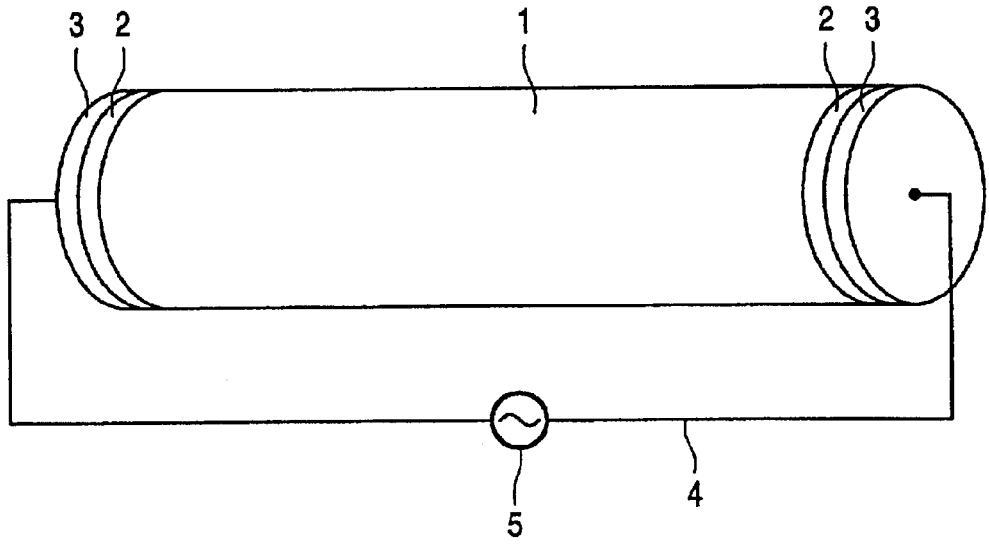
FIG. 1 is a diagrammatic picture of a gas discharge lamp.

The gas discharge lamp shown in FIG. 1 comprises a substantially tubular discharge vessel 1, for example made of quartz glass, whose inner surface is coated with a luminescent layer and which encloses a discharge space with a discharge gas. At its mutually opposed axial ends, the vessel is closed by respective capacitive coupling structures. The coupling structures are formed each by two substantially disk-shaped elements 2, 3, the first element 2 adjoining the discharge space and the second element 3 adjoining the outer surface of the vessel 1.

The first element 2 is formed by a ceramic material, whereas the second element 3 is an electrically conductive layer, for example made of conductive silver, to which connection wires 4 are fastened for connection to an AC voltage source 5.

The two coupling structures each operate as a plate capacitor on account of their disc-shaped elements. The application of an AC voltage leads to the formation of an AC electric field in the discharge vessel, which causes an excitation of the gas discharge and the ensuing continuous operation of the lamp in a known manner.

The operational properties of the lamp are decisively influenced by the ceramic material of the coupling structures. To optimize these properties, the material should have as high as possible a saturation polarization $P_S$ and a high dielectric constant. Furthermore, the hysteresis loop should be as rectangular as possible. Finally, a Curie temperature $T_C$ lying above the operating temperature of the lamp and a coercitive field strength $E_C$ lying below the operating voltage of the lamp are required.

Experiments have shown that the operating temperatures of gas discharge lamps can be raised in principle to 100 and more degrees. The known coupling structures, however, are not suitable for this because the ferroelectric ceramic material becomes paraelectric at such high operating temperatures. This has the result that the dielectric constant and the saturation polarization are reduced, and the coercitive field strength and the shape of the hysteresis loop are impaired.

According to the invention, therefore, a ceramic material is used for the coupling structures which comprises pure $BaTiO_3$, i.e. without doping and without zirconium, instead of the $Ba(Ti_{1-x}Zr_x)O_3$ mentioned above. The former material has a Curie temperature of approximately 130° C.

The Curie temperature may be raised even more if the barium is replaced at least partly by lead.

The $BaTiO_3$ may be doped at least partly with donors/acceptors for a further increase in the saturation polarization and for a decrease in the coercitive field strength.

It was found to be particularly advantageous in this connection when the $BaTiO_3$ is doped on the one hand with barium, which is added in the form of $BaCO_3$, as well as, on the other hand, with approximately 0.05% manganese in the titanium locations.

The barium doping here preferably remains below 2%, while the manganese doping may lie in a range of between 0.01 and 1%.

Figure 2:
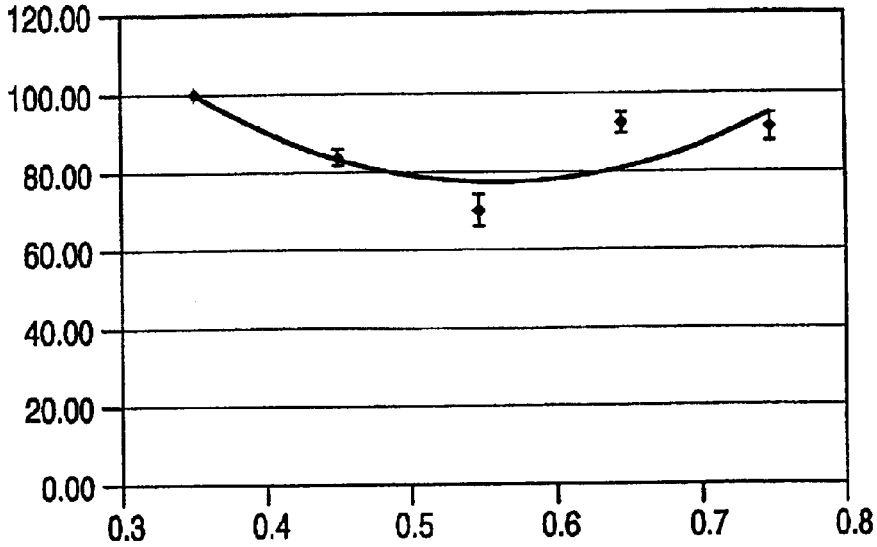
FIG. 2 shows the gradient of the coercitive field strength as a function of a Ba doping.

FIG. 2 shows the gradient of the coercitive field strength $E_C$ thus achieved as a function of the quantity of the barium dopant between 0.3 and 0.8% for a constant manganese doping of 0.05%. A minimum value of this field strength of below 80 V/mm is found for approximately 0.55% barium.

Figure 3:
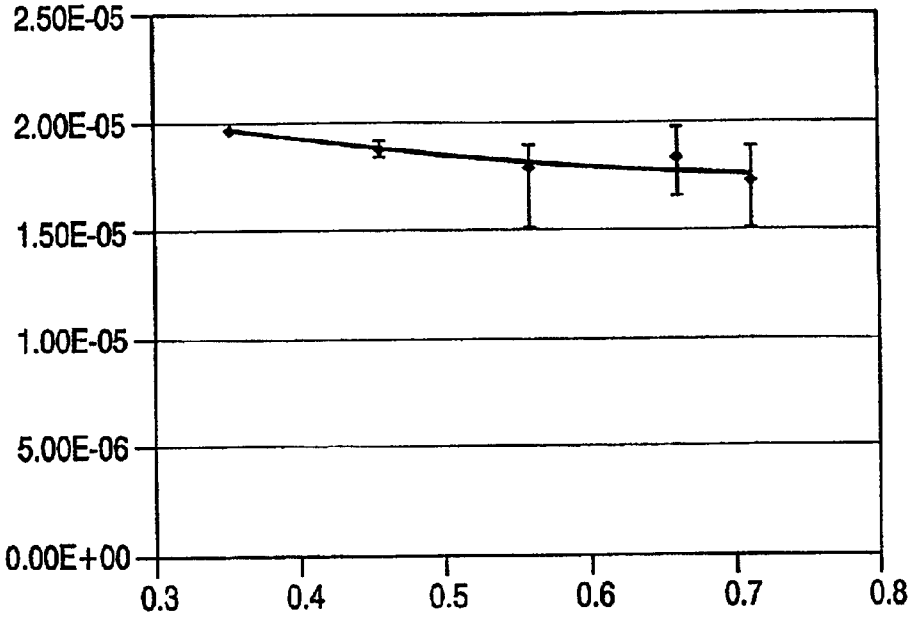
FIG. 3 shows the gradient of the saturation polarization as a function of a Ba doping.

FIG. 3 finally shows the gradient of the saturation polarization $P_S$ for such a doping. As the curve clearly shows, values of 17 $\mu C/cm^2$ and more can be achieved in a region between approximately 0.35 and approximately 0.75% barium.

It was finally found that a lead doping of the $BaTiO_3$ of less than 2% can increase the Curie temperature further, while a titanium doping of at most approximately 2% renders possible a further approximation of the shape of the hysteresis loop towards the ideal rectangular shape.

What is claimed is:

1. A gas discharge lamp comprising at least two two-element capacitive coupling structures adjoining the discharge space at its mutually opposed axial ends, wherein said coupling structure (2,3) comprises a ceramic material which comprises pure $BaTiO_3$.

2. The gas discharge lamp as claimed an claim 1, wherein the ceramic material comprises $BaTiO_3$ in which the barium has been wholly or partly replaced by lead.

3. The gas discharge lamp as claimed in claim 1, wherein the ceramic material comprises $BaTiO_3$ which is doped with manganese in the titanium location.

4. The gas discharge lamp as claimed in claim 3, wherein a quantity of between approximately 0.01 and 1% manganese is provided for doping in the titanium location.

5. The gas discharge lamp as claimed in claim 1, wherein the ceramic material comprises $BaTiO_3$ doped with barium, said barium doping amounting to less than 2%.

6. The gas discharge lamp as claimed in claim 5, wherein $BaCO_3$ is provided as the dopant.

7. The gas discharge lamp as claimed in claim 1, wherein the ceramic material comprises $BaTiO_3$ which is doped with lead doping amounting to less than 2%.

8. The gas discharge lamp as claimed in claim 1, wherein the ceramic material comprises BaTiO3 which is doped with titanium, said titanium doping amounting to at most 2%.

9. A gas discharge lamp comprising at least two two-element capacitive coupling structures adjoining the discharge space at its mutually opposed axial ends, wherein said coupling structure (2,3) comprises a ceramic material which comprises pure BaTiO3, and wherein each of the two-element capacitive coupling structures are formed by a first element and a second element.

10. The gas discharge lamp of claim 9 wherein the capacitive coupling structures are substantially disc-shaped.

11. The gas discharge lamp of claim 9 wherein the first element adjoins the discharge space and the second element adjoins an outer surface of the vessel.

12. The gas discharge lamp of claim 9 wherein the coupling structures operate as a plate capacitor.

13. The gas discharge lamp as claimed in claim 9, wherein the ceramic material comprises $BaTiO_3$ in which the barium has been wholly or partly replaced by lead.

14. The gas discharge lamp as claimed in claim 9, wherein the ceramic material comprises $BaTiO_3$ which is doped with manganese in the titanium location.

15. The gas discharge lamp as claimed in claim 14, wherein a quantity of between approximately 0.01 and 1% manganese is provided for doping in the titanium location.

16. The gas discharge lamp as claimed in claim 9, wherein the ceramic material comprises $BaTiO_3$ doped with barium, said barium doping amounting to less than 2%.

17. The gas discharge lamp as claimed in claim 16, wherein $BaCO_3$ is provided as the dopant.

18. The gas discharge lamp as claimed in claim 9, wherein the ceramic material comprises $BaTiO_3$ which is doped with lead doping amounting to less than 2%.

19. The gas discharge lamp as claimed in claim 9, wherein the ceramic material comprises $BaTiO_3$ which is doped with titanium, said titanium doping amounting to at most 2%.

* * * * *